United States Patent [19]

Yan

[11] Patent Number: 4,962,276

[45] Date of Patent: Oct. 9, 1990

[54] PROCESS FOR REMOVING MERCURY FROM WATER OR HYDROCARBON CONDENSATE

[75] Inventor: Tsoung Y. Yan, Philadelphia, Pa.

[73] Assignee: Mobil Oil Corporation, Fairfax, Va.

[21] Appl. No.: 297,157

[22] Filed: Jan. 17, 1989

[51] Int. Cl.[5] ..... C07C 7/00; C10G 29/20

[52] U.S. Cl. ..... 585/867; 423/107; 423/210; 208/251 R; 210/914

[58] Field of Search ..... 423/210, 107; 585/867; 208/251 R; 210/914; 55/46, 48

[56] References Cited

U.S. PATENT DOCUMENTS

| | | | |
|---|---|---|---|
| 2,860,952 | 11/1958 | Bergeron et al. | 423/102 |
| 3,039,845 | 6/1962 | Steinrotter et al. | 55/54 |
| 3,194,629 | 7/1965 | Dreibelbis et al. | 423/210 |
| 3,674,428 | 4/1972 | Dean et al. | 423/106 |
| 3,749,761 | 4/1973 | Dean et al. | 423/566 |
| 3,790,370 | 2/1974 | Lalancette et al. | 75/108 |
| 3,847,598 | 11/1974 | Coulter et al. | 210/914 |
| 3,857,704 | 12/1974 | Coulter | 210/914 |
| 4,053,401 | 10/1977 | Fukushima et al. | 210/52 |
| 4,147,626 | 4/1979 | Findlay et al. | 210/52 |
| 4,474,896 | 10/1984 | Chao | 502/216 |
| 4,599,177 | 7/1986 | Hayashi et al. | 210/914 |
| 4,709,118 | 11/1987 | Yan | 208/251 R |

FOREIGN PATENT DOCUMENTS

| | | | |
|---|---|---|---|
| 117450 | 12/1970 | Japan | 210/914 |
| 1530489 | 11/1978 | United Kingdom | 423/107 |

*Primary Examiner*—Jeffrey E. Russel
*Assistant Examiner*—Brian M. Bolam
*Attorney, Agent, or Firm*—Alexander J. McKillop; Charles J. Speciale

[57] ABSTRACT

A method for removing mercury from water or hydrocarbon condensate is provided. The mercury-containing liquid is sprayed into a stripper having a packing therein to facilitate its contact with a stripping gas such as air or natrual gas. The stripped product is drawn from the bottom of the stripper. The stripping gas which carries the mercury from the stripper is passed over an active adsorbent to remove the mercury. The cleaned gas may be used or recycled.

21 Claims, 1 Drawing Sheet

PROCESS FOR REMOVING MERCURY FROM WATER OR HYDROCARBON CONDENSATE

BACKGROUND OF THE INVENTION

The field of the invention relates to the removal of mercury from a liquid such as water or hydrocarbon condensate.

Hydrocarbons, both gas and condensate, produced from certain natural gas fields have been found to contain significant amounts of mercury. The gas and condensate from one field, for example, are found to have mercury contents of about 250 and 200ppb, respectively. The presence of mercury in the gas and condensate causes both processing and environmental concerns.

Water co-produced from gas and oil wells also may contain significant amounts of mercury. For example, concentrations of 70–150 ppb of mercury have been observed in water produced from gas wells in certain natural gas fields. In addition, mercury-contaminated water is produced in various manufacturing processes. The discharge streams from chlor-alkali plants have sometimes been found to contain unacceptable mercury levels. It is environmentally unacceptable to discharge such mercury-containing effluent to rivers or oceans.

Various processes have been developed for removing mercury from liquids. U.S. Pat. Nos. 2,860,952, 3,674,428, 3,749,761, 3,790,370, 3,847,598, 4,053,401, 4,147,626 and 4,474,896 disclose a number of methods for reducing the mercury content from aqueous solutions. Most of these methods involve the addition of certain chemicals to the solution to precipitate the mercury compounds or the use of adsorbents. U.S. Pat. No. 3,847,598 discloses a process including passing a stream of inert gas through an aqueous solution in the presence of a reducing agent and subsequently recovering mercury vapor from the inert gas. The process is used for treating depleted brine used in the manufacture of chlorine and caustic soda.

Mercury removal processes for treating water which involve the use of sulfides can be enhanced by the addition of polysulfides. However, such processes are relatively costly and require close control of conditions. The treated stream has a reduced mercury content but is greatly enriched with sulfides and COD, therefore requiring further treatment. Furthermore, it is difficult to remove the fine particles of HgS from the system.

Mercury in water can also be removed by passing it over active adsorbents such as sulfur/carbon, Ag-/$A1_20_3$, Ag/C, and CuS/$A1_20_3$. Water produced at natural gas wells may contain contaminants other than mercury which can foul the adsorbents.

A technique for removing mercury from condensate has involved washing the condensate with a dilute alkali solution of $Na_2S_x$. The consumption rate of the $Na_2S_x$ is high due to the fact that many compounds in the condensate compete with mercury for reaction with the $Na_2S_x$. In addition, the by-product of this process causes disposal problems.

SUMMARY OF THE INVENTION

It is an object of the invention to provide a method for removing mercury from water or hydrocarbon condensate which includes none of the disadvantages associated with the use of adsorbents or chemicals for precipitating mercury.

The method according to the invention involves the use of a mercury stripper which may be in the form of a column packed with structural packings or the like. The mercury-containing condensate or water is charged to the stripper in the form of a spray while a stripping gas is introduced near the bottom of the stripper. The stripping gas, which includes mercury from the condensate or water, is withdrawn from the top of the stripper while the stripped condensate or water is drawn from the bottom thereof. After such removal from the stripper, the gas is treated by an adsorber or scrubbing system to remove the mercury therefrom.

BRIEF DESCRIPTION OF THE DRAWINGS

The figure is a schematic illustration of a system for removing mercury from water or hydrocarbon condensate.

DETAILED DESCRIPTION OF THE INVENTION

Figure 1:
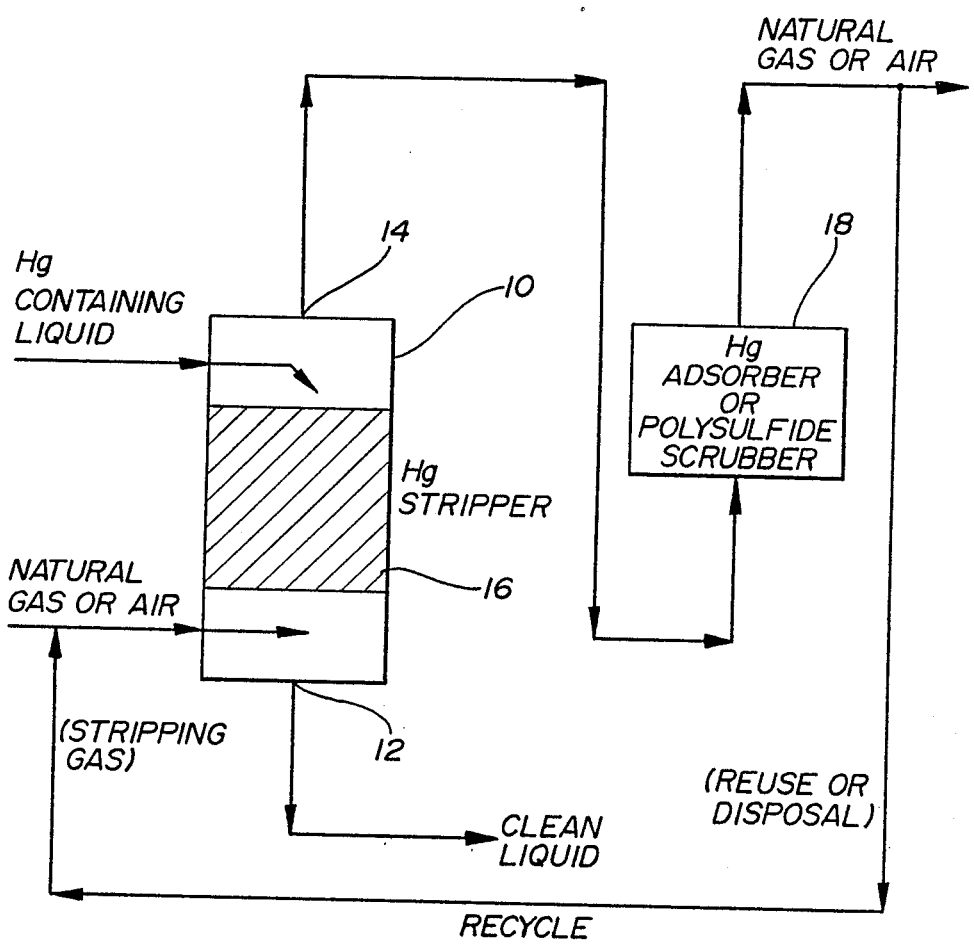

An effective method for removing mercury from water, hydrocarbon condensate or other substantially liquid substance is provided.

Referring to the drawing, the mercury-contaminated liquid is introduced near the top of a stripper 10 in the form of a spray or mist. A stripping gas is introduced near the bottom of the stripper. The stripper includes a first outlet 12 at or near the bottom thereof and a second outlet 14 at or near the top. A packing 16 made from structural packing material or the like is provided to increase the exposure of the liquid to the stripping gas. The stripper itself may be in the form of a cylindrical column or tower as shown in the drawing.

The stripping gas flows through the stripper and removes mercury as mercury vapor from the condensate or water. The cleaned product is drawn from the bottom outlet 12 of the stripper while the mercury-containing gas exits through the top outlet 14 thereof. The residence time of the water or condensate within the stripper is up to about thirty minutes, with one to ten minutes being the preferred range. The liquid superfacial velocity is 1–200 gpm/ft$^2$, (gallons per minute per squre foot of cross sectional surface area) and preferably about 5–50 gpm/ft$^2$. Gas superfacial velocity is between 50–5,000 cubic feet per minute per square foot, and preferably 300–1,000 ft.$^3$/m/ft.$^2$. If condensate is treated, the pressure within the stripper is between about 0–1,000 psi, and preferably 0–500 psi. The general and preferred pressure ranges for water are 0–500 and 0–100 psi, respectively.

The stripping operation is conducted at a temperature of at least 200° F where condensate is being treated. Higher temperature ranges are preferred, such as 300–500° F, so that light hydrocarbons are also removed. Upon mercury removal, the vapor can be condensed to recover the light hydrocarbons. Less stripping gas is required at higher operating temperatures. The operating temperature for water should be about 50–200° F.

The stripping gas utilized in the process may be any of a number of gases including, for example, air, $N_2$, $CO_2$, $H_2$, or natural gas. Natural gas is preferred for the removal of mercury from hydrocarbon condensate because of its availability and due to the fact that it may be recovered as the product subsequent to purification. Air is preferred for treating water.

A mercury adsorber or a scrubber 18 is used to treat the stripping gas after it exits the stripper 10. The adsorber may include a fixed bed of active solid adsorbents such as sulfur/carbon, Ag/carbon, $Ag/Al_2O_3$, $CuS/Al_2O_3$, CuS/carbon, $FeS/Al_2O_3$, FeS/carbon or $Bi/Al_2O_3$. The adsorber should be sufficiently large to remove ninety percent of the mercury from the stripping gas. Typical superfacial gas velocity through the bed should be between 0.1–50ft./sec. and preferably one half to ten feet per second. Depending upon the nature and activity of the adsorbent, the temperature should be maintained at 50–400° F.

A polysulfide scrubbing system may alternatively be used to remove mercury from the stripping gas, unless the stripping gas is air. The mercury-containing stripping gas is passed through a scrubbing tower where it is scrubbed with a dilute alkali solution of $Na_2S_x$. The tower is preferably packed with structural packing, although a bubble cup or sieve tray could also be employed.

Other known processes may be used to adsorb mercury vapor from the stripping gas. U.S. Pat. No. 3,194,629, which is incorporated by reference herein, discloses one such process.

The process of removing mercury from condensate can be easily integrated into existing LNG plants. The stripper can be made from a drum having dimensions of about 3.2m in diameter and 5.9m in height. The vessel is half filled with structural packing. A small fraction of the clean gas from the adsorber or scrubber unit, which treats the incoming raw natural gas, is recycled to the bottom of the drum to strip the condensate. The condensate is withdrawn from the drum and may be sold. The gas is mixed with the incoming raw natural gas and treated in the adsorber or scrubber. To further improve the operation a portion of the cleaned condensate can be recycled to the top of the drum as a reflux.

EXAMPLE 1

A glass column of 2.5cm I.D. and 30cm in length was filled with stainless steel packing. Water containing about 25ppb mercury was pumped into the column from the top and nitrogen stripping gas was introduced at the bottom of the column. The water and nitrogen gas flowed counter-currently, and the gas and water samples were collected for mercury analyses. The test was conducted at about 100° F. It was found that over ninety percent of the mercury can be stripped off the water at a stripping rate of 1,000cc of nitrogen per cc of water. As the nitrogen stripping rate increases, the mercury remaining in the water decreases. The mercury containing stripping gas was passed over a fixed bed of sulfur impregnated carbon to remove the mercury. Effluent gas was analyzed and found to contain less than $1\times10^{-12}$ g/g of mercury.

The method according to the invention results in the removal of between seventy and ninety-five percent of the mercury contaminated in the water or hydrocarbon condensate. It is environmentally sound in that it does not create new disposal problems.

What is claimed is:

1. A method for removing mercury from hydrocarbon condensate comprising:
   - providing a stripper having a top, a bottom, and a packing therein;
   - forming said hydrocarbon condensate into a spray;
   - introducing said spray into said stripper and into contact with said packing;
   - flowing a gas stream through said stripper, thereby stripping mercury from said hydrocarbon condensate;
   - removing said stripped hydrocarbon condensate from the bottom of said stripper; and
   - removing said gas, including said stripped mercury, from the top of said stripper.

2. A method as defined in claim 1 including the steps of removing mercury from said gas after its removal from said stripper.

3. A method as defined in claim 1 wherein said liquid flows through said stripper at a rate of about five to fifty gpm/ft.$^2$gallons per minute per square foot of cross sectional surface area.

4. A method as defined in claim 1 including the step of maintaining the temperature within said stripper at at least 200° F.

5. A method as defined in claim 1 including the step of maintaining the temperature within said stripper between 300–500° F.

6. A method as defined in claim 1 including the step of recycling a portion of said condensate removed from said stripper back into said stripper.

7. A method as defined in claim 1 wherein said gas is natural gas.

8. A method as defined in claim 7 including the steps of providing a stream of raw, mercury-containing natural gas, removing said mercury from said raw natural gas, and flowing said natural gas into said stripper once said mercury has been removed therefrom.

9. A method as defined in claim 8 including the step of introducing said natural gas removed from said stripper into said stream of raw, mercury-containing natural gas.

10. A method as defined in claim 2 wherein packing is a structural packing.

11. A method as defined in claim 2 wherein said spray is a mist.

12. A method as defined in claim 2 including the step of passing said gas through a solid adsorbent after its removal from said stripper.

13. A method as defined in claim 12 wherein said solid adsorbent is selected from the group consisting of sulfur/carbon, Ag/carbon, $Ag/Al_2O_3$, $CuS/Al_2O_3$, CuS/carbon, $FeS/Al_2O_3$, FeS/carbon or $Bi/Al_2O_3$.

14. A method for removing mercury from mercury-containing hydrocarbon condensate, comprising:
   - spraying said condensate into a stripper;
   - maintaining the temperature within said stripper at at least 200° F;
   - flowing a stripping gas comprising natural gas within said stripper in a direction opposite to the direction said condensate travels within said stripper, said gas stripping said mercury from said condensate;
   - removing said stripped condensate from said stripper;
   - removing said gas including said stripped mercury from said stripper; and
   - removing said stripped mercury from said gas.

15. A method as defined in claim 14 wherein said temperature is maintained between 300° F and 500° F.

16. A method as defined in claim 14 including the steps of providing a stream of raw, mercury-containing natural gas, removing said mercury from said raw natural gas, and flowing said natural gas into said stripper once said mercury has been removed therefrom.

17. A method as defined in claim 16 including the step of introducing said natural gas removed from said stripper into said stream of raw, mercury-containing natural gas.

18. A method as defined in claim 1 including the step of maintaining a pressure between about 0–1,000 psi within said stripper.

19. A method as defined in claim 1 including the step of maintaining a pressure between 0–500 psi within said stripper.

20. A method as defined in claim 14 including the step of maintaining a pressure between about 0–1,000 psi within said stripper.

21. A method as defined in claim 14 including the step of maintaining a pressure between 0–500 psi within said stripper.

* * * * *

UNITED STATES PATENT AND TRADEMARK OFFICE

CERTIFICATE OF CORRECTION

PATENT NO. : 4,962,276

DATED : October 9, 1990

INVENTOR(S) : Tsoung Y. Yan

It is certified that error appears in the above-identified patent and that said Letters Patent is hereby corrected as shown below:

ON THE TITLE PAGE:

Abstract, line 5, "natrual" should read --natural--.

Col. 4, claim 3, line 3, delete "gpm/ft.$^2$".

Signed and Sealed this

Seventeenth Day of March, 1992

*Attest:*

HARRY F. MANBECK, JR.

*Attesting Officer*

*Commissioner of Patents and Trademarks*